US006928688B2

(12) United States Patent
Nam

(10) Patent No.: US 6,928,688 B2
(45) Date of Patent: Aug. 16, 2005

(54) HAND TOOL FOR CLEANING

(76) Inventor: Daegon Nam, 573-2, Daechen-dong, Dalseo-gu, Taegu (KR), 704-330

( * ) Notice: Subject to any disclaimer, the term of this patent is extended or adjusted under 35 U.S.C. 154(b) by 0 days.

(21) Appl. No.: 10/856,725

(22) Filed: May 28, 2004

(65) Prior Publication Data

US 2004/0216255 A1 Nov. 4, 2004

Related U.S. Application Data

(63) Continuation of application No. PCT/KR02/02229, filed on Nov. 28, 2002.

(51) Int. Cl.[7] ..... A47L 13/10

(52) U.S. Cl. ..... 15/225; 15/209.1; 15/226; 15/229.2

(58) Field of Search ..... 15/209.1, 210.1, 15/211, 223–226, 228, 229.1, 229.2, 230.13

(56) References Cited

U.S. PATENT DOCUMENTS 581,109 A * 4/1897 Fairchild ..... 15/226
1,866,862 A * 7/1932 Prestwich et al. ..... 15/210.1
2,744,279 A * 5/1956 Heber ..... 15/210.1
2,908,930 A * 10/1959 Gasper ..... 15/210.1
4,190,921 A * 3/1980 Rose ..... 15/225
4,423,532 A * 1/1984 Yagi et al. ..... 15/182

* cited by examiner

*Primary Examiner*—Mark Spisich
(74) *Attorney, Agent, or Firm*—McCarter & English, LLP

(57) ABSTRACT

Disclosed herein is a hand tool for cleaning areas within reach of a user's arm. The cleaning tool includes a screw part (20) to which a long cleaning cloth (27) is helically fastened, and a handle (10) connected to the screw part. In the cleaning tool, the screw part includes a fitting hole receiving a fastening member for fastening the cleaning cloth to the screw part. A plurality of annular ribs (21) are provided on the screw part at regular intervals, with a recess (22) being formed on each of the ribs. According to the cleaning tool of the present invention, the screw part has a simple structure, thus dramatically reducing the manufacturing cost of a metal mold for producing the screw parts, as well as allowing the cloth to be firmly fastened to the screw part.

2 Claims, 3 Drawing Sheets

PRIOR ART

HAND TOOL FOR CLEANING

CROSS REFERENCE TO RELATED APPLICATIONS

This is a continuation of International Patent Application No. PCT/KR02/02229 filed Nov. 28, 2002 and published Jun. 12, 2003 in the English language under International Publication Number WO 03/047414 A1, the disclosure of which is hereby incorporated by reference herein in its entirety.

FIELD OF THE INVENTION

The present invention relates generally to hand tools for cleaning, and more particularly, to an improved hand tool for cleaning areas within reach of a user's arm, which has the shape of a short bar, and is provided with a screw part to which a cleaning cloth is fastened and a handle connected to the screw part.

BACKGROUND OF THE INVENTION

Generally, when it is required to clean a space, a person must uncomfortably bend down to wipe a cloth over the space. In order to save such trouble, recently there have been developed various types of cleaning tools, such as mops with a pad-type cleaning cloth. However, such a mop, which is widely used for cleaning, has a problem in that the pad-type cleaning cloth attached to the shank of the mop is small in surface area, so the cloth becomes easily and undersirably dirty, thus the cloth must be frequently removed from the shank of the mop to be washed, therefore causing inconvenience to a user. Further, the mop has another problem in that, when one desires to clean a narrow space or the lower surface of an object, the width of the pad-type cleaning cloth is wider relatively than the space to be cleaned, so a person inconveniently must bend down to clean such a narrow space.

In order to solve such problems, there have been proposed roller-type cleaning tools, which were filed by the inventor of the present invention and are disclosed in Korean U.M. Laid-open publication No. 2000-0002283 and Korean U.M. Registration No. 20-0201758. The above roller-type cleaning tools overcome the aforementioned problems of the mops having the pad-type cleaning cloth. That is, the roller-type cleaning tools may easily clean a narrow space, and are designed to be rotatable so that the contaminated part of a cleaning cloth is easily replaced by a clean part.

FIG. 1 is an exploded perspective view showing the roller-type cleaning tool, which was filed by the inventor of the present invention and is disclosed in Korean U.M. Laid-open publication No. 2000-0002283. As shown in the drawing, the cleaning tool 10 has the shape of a long cylindrical bar 12 with a handle 11. A cloth drive unit 13 is provided at a lower portion of the cleaning tool 10. Two cloth units 14 are removably mounted to the cloth drive unit 13. Each cloth unit 14 includes a cleaning cloth 35 and a cylindrical body 30. The body 30 is provided with an axial hole 31 so that the body 30 is fitted over a rotor 22 of the cloth drive unit 13. A locking recess (not shown) is provided on the inner surface of the body 30, and engages with a locking projection 28 provided on the rotor 22 so as to prevent the cloth unit 14 from being unexpectedly removed from the cloth drive unit 13. The body 30 also has a screw part 38 which comprises a crest 36 and a root 37 so that the cloth 35 is helically wound around and fastened to the body 30. The reference numerals 20 and 29 denote bevel gears, 24 denotes stator and 27 denotes slot.

FIG. 2 is a perspective view showing a screw part included in the roller-type cleaning tool which was invented by the inventor of the present invention and is disclosed in Korean U. M. Registration No. 20-0201758. The cleaning tool is designed such that a cleaning cloth is helically wound around and fastened to a screw part 7 which is provided on the outer surface of a cylindrical body with an axial hole 70. A plurality of first annular ribs 72 are provided along the entire length L of the screw part 7 at regular intervals. Each of the first ribs 72 is provided with a recess 71. Further, a second annular rib 72' is concentrically provided between two neighboring first ribs 72. That is, the second ribs 72' are alternately positioned between the first ribs 72. Each second rib 72' is smaller in diameter than each first rib 72. The second ribs 72' prevent the cleaning cloth from being deeply inserted into the spaces between the first ribs 72 when the long cloth is helically wound around and fastened to the screw part 7, thus preventing the surface area of the cloth used for cleaning from being undesirably reduced. Since the cleaning tool is provided with the two types of ribs 72 and 72' each having a recess 71, similar to a screw part having a crest and a root, the cloth is compressed while being rotated to be wound around the screw part 7. Meanwhile, it is difficult to manufacture a metal mold for producing the screw part having the crest and the root. However, the cleaning tool needs not use the screw part having the crest and the root, thus reducing the manufacturing cost and fraction defective thereof However, such conventional roller-type cleaning tools have a problem that it is difficult to clean a narrow space of a short distance within reach of a user's arm, because the cleaning tools have the shape of a long bar and a large cloth. Thus, when one desires to clean narrow spaces within reach of a user's arm, only the cloth unit removed from the cleaning tool may be used. However, in the case where only the cleaning cloth is used, it is inconvenient to grasp the cloth.

SUMMARY OF THE INVENTION

Accordingly, the present invention has been made keeping in mind the above problems occurring in the prior art, and an object of the present invention is to provide a hand tool for cleaning, which has the shape of a short bar, thus allowing a user to easily clean areas within reach of the user's arm.

Another object of the present invention is to provide a hand tool for cleaning, which is provided with a screw part of a simple structure, thus allowing a cleaning cloth to be fly wound around the screw part and dramatically reducing the manufacturing cost of a metal mold for producing the screw parts.

In order to accomplish the above object, the present invention provides a hand tool for cleaning a short range within reach of a user's arm, including a screw part to which a long cleaning cloth is helically fastened, and a handle connected to the screw part, wherein the screw part includes a fitting hole receiving a fastening member for fastening the cleaning cloth to the screw part, and a plurality of annular ribs provided on the screw part at regular intervals, with a recess being formed on each of the ribs.

The handle has a short bar shape, thus allowing a user to easily clean a narrow spaces within a short range. In addition, the cleaning cloth is more firmly fastened to the screw part using the fastening member and the fitting hole. The screw part is provided with only one kind of ribs each having a recess, so its structure is very simple, thus remarkably reducing the manufacturing cost of a metal mold for producing the screw parts in comparison with the manufacturing cost of a metal mold for producing conventional screw parts.

The present invention provides a hand tool for cleaning, which is designed such that the cleaning cloth fastened to the screw part is made of microfiber, and is fastened to the screw part by attaching the cloth to the screw part, laying a packing member on the cloth at a position above the fitting hole, and fitting the fastening member into the fitting hole to fasten the packing member and cloth to the screw part.

The cloth made of microfiber is easy to wash, has excellent air permeability, and is not easily deformed even when used for a lengthy period of time. Further, the cloth made of microfiber has high resistance to chemicals and high durability, thus being economical. Further, when the packing member is used, the screw part, the cloth, and the packing member are in surface contact with each other, thus providing a high fastening force, therefore preventing the cloth from being undesirably removed from the screw part.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
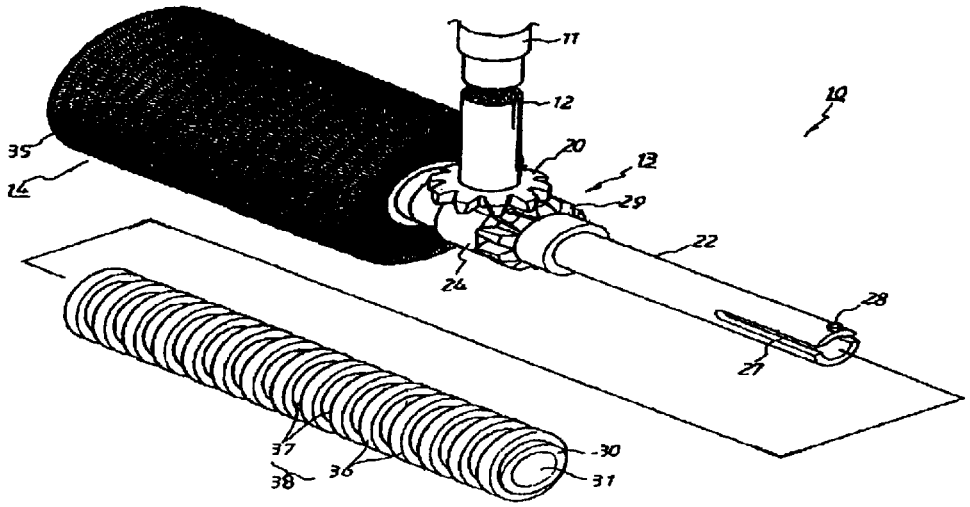
FIG. 1 is an exploded perspective view showing a conventional cleaning tool.

Reference should now be made to the drawings, in which the same reference numerals are used throughout the different drawings to designate the same or similar components.

Figure 3:
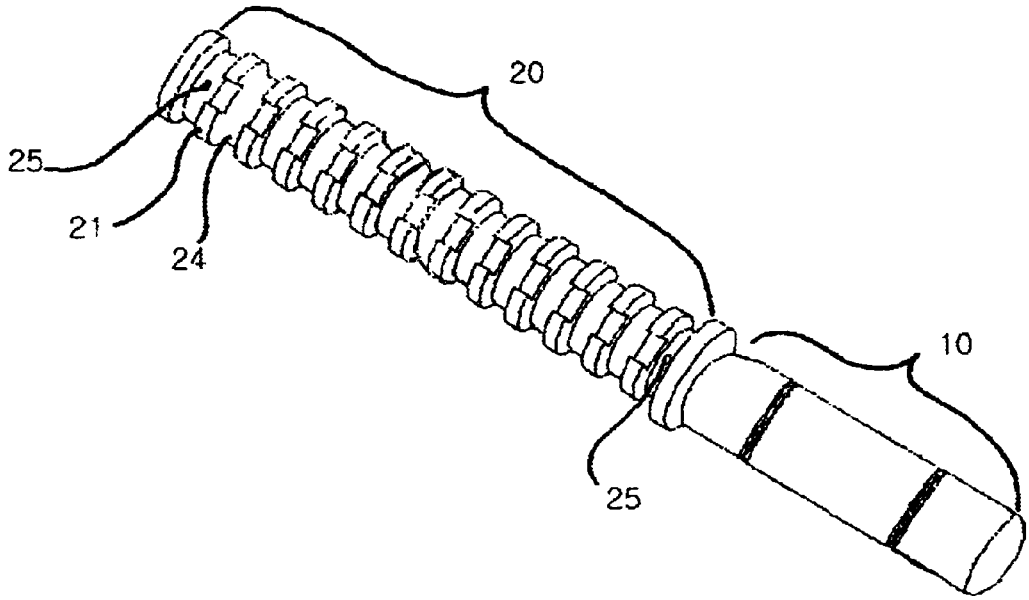
FIG. 3 is a perspective view showing a hand tool for cleaning according to a preferred embodiment of the present invention, with a cleaning cloth removed from the tool.

FIG. 3 is a perspective view showing a hand tool for cleaning according to a preferred embodiment of the present invention. Different from conventional cleaning tools which were filed by the inventor of the present invention, the cleaning tool of the present invention has the shape of a short bar around which a cleaning cloth is wound, so it is hand-held type. The bar-shaped cleaning tool includes a screw part 20 to which the cloth is fastened and a handle 10 connected to the screw part 20. Preferably, the entire length of the tool is 25–35 cm, the length of the handle 10 is 10–15 cm, and the diameter of the handle is 2–5 cm, thus allowing a user to easily hold the tool when cleaning.

A plurality of annular ribs 21 are provided on the screw part 20 at regular intervals. Each rib 21 is provided with a recess 22. Further, a groove 24 is formed between two neighboring ribs 21. That is, the grooves 24 are alternately positioned between the ribs 21. The reference numerals 25 and 25' denote bolt fitting holes. That is, bolts are tightened to the bolt fitting holes 25 and 25' to firmly fasten the cleaning cloth to the screw part 20.

Figure 4:
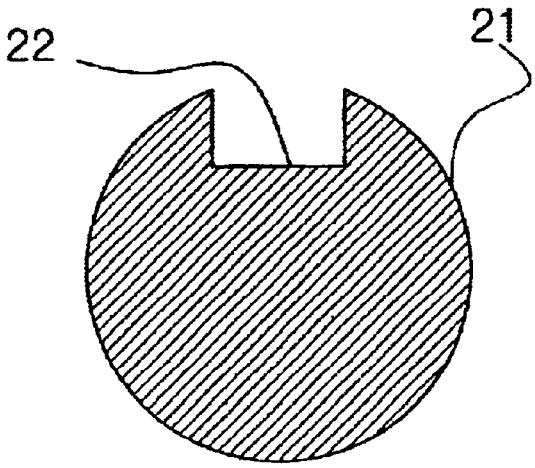
FIG. 4 is a sectional view of a rib provided on a screw part of the hand tool for cleaning according to the present invention.

FIG. 4 is a sectional view of one of the ribs 21 which are provided on the screw part 20 shown in FIG. 3. As shown in FIG. 4 in detail, the rib 21 has a ring shape and is projected from the screw part 20. Further, the recess 22 is formed at a predetermined portion of the rib 21.

Figure 2:
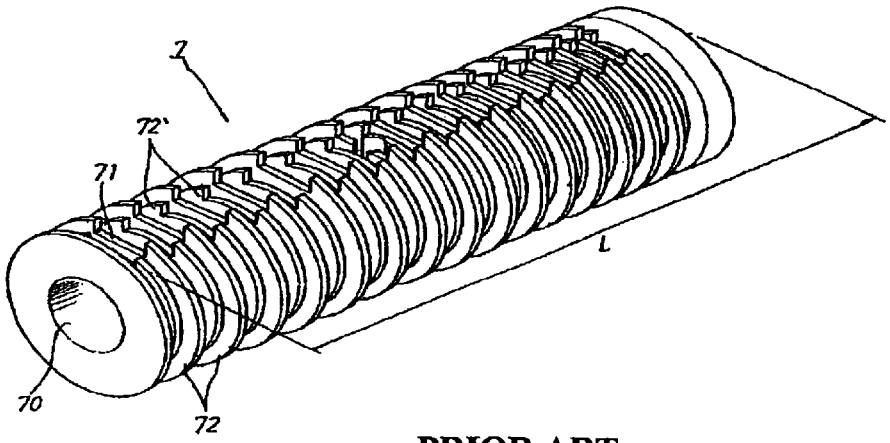
PRIOR ART Fig. 2
FIG. 2 is a perspective view showing a screw part of another conventional cleaning tool.

The conventional cleaning tool shown in FIG. 2 includes two kinds of ribs, that is, first ribs 72 of a large diameter and second ribs 72' of a small diameter, which are provided with recesses 71. However, the cleaning tool according to the present invention includes only one kind of ribs 21 with the recesses 22. Since the cleaning tool of the present invention has a diameter of 2–5 cm, the cleaning cloth is not deeply fitted into a space between the ribs 21. Thus, the cleaning tool of the present invention needs not have two kinds of ribs. As a result, the construction of the screw part 20 is simplified, thus dramatically reducing the manufacturing cost of a metal mold for producing the screw parts 20.

Figure 5:
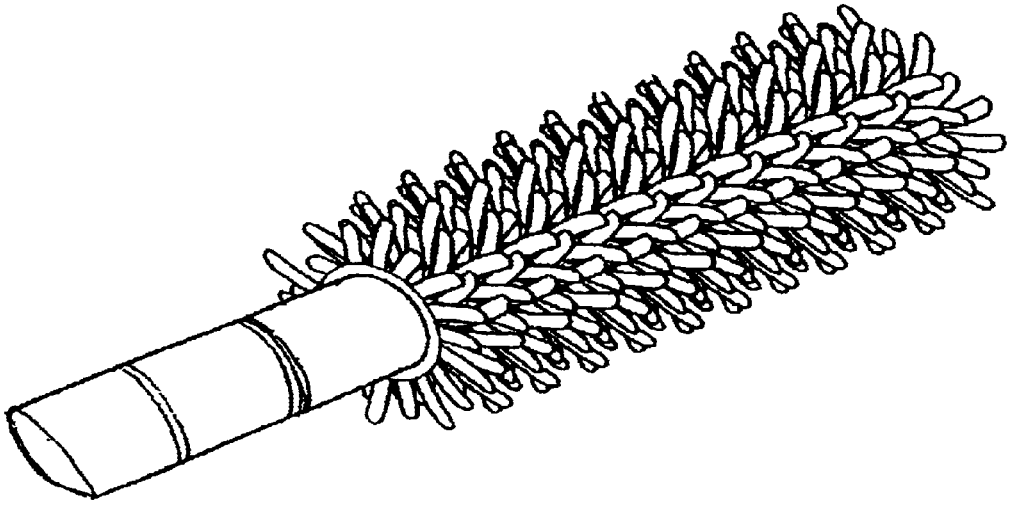
FIG. 5 is a perspective view showing the hand tool for cleaning according to the present invention, with a cleaning cloth attached to the tool.

FIG. 5 is a perspective view showing a hand tool for cleaning according to the present invention. The cleaning tool of FIG. 5 includes a long cleaning cloth which is woven from microfiber. In order to fasten the cleaning cloth to the screw part, the cleaning cloth is helically rotated along the screw part. The microfiber has several excellent properties. That is, the microfiber is easy to clean, has excellent air-permeability, and is not easily deformed even when used for a lengthy period of time. Further, the microfiber has a high resistance to chemicals, so it is not deformed when submerged in a liquid chemical material, such as a detergent, bleaching solution, thus being economical.

Figure 6:
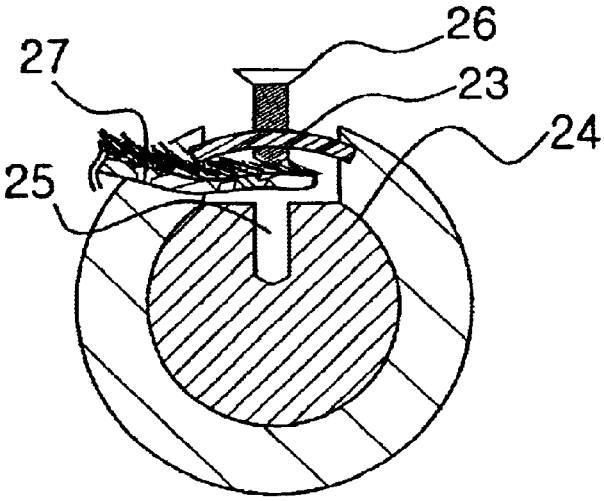
FIG. 6 is a sectional view showing the cleaning cloth fastened to a fitting hole of the screw part according to the present invention.

As shown in FIG. 3, the bolt fitting holes 25 and 25' are formed at the grooves 24 at both ends of the screw part 20. FIG. 6 is a sectional view showing the cleaning cloth 27 fastened to the fitting hole 25 of the screw part 20. The process of fastening the cleaning cloth 27 to the screw part 20 is as follows. First, the end of the cleaning cloth 27 is placed above the bolt fitting hole 25 which is formed on the groove 24. Next, the cleaning cloth 27 is fastened to the screw part 20 by fitting a bolt 26 into the bolt fitting hole 25. At this time, a packing member 23 may be interposed between the bolt 26 and the bolt fitting hole 25, so that the groove 24, the cleaning cloth 27, and the packing member 23 are in surface contact with each other, thus providing a high fastening force, therefore preventing the cleaning cloth 27 from being undesirably removed from the screw part 20.

INDUSTRIAL APPLICABILITY

As described above, the present invention provides a hand tool for cleaning, which has a shape of a short bar, thus allowing a user to easily clean areas within reach of a user's arm. In addition, the cleaning tool of the present invention allows a user to easily clean an uneven surface or narrow spaces which are difficult to clean by hand.

Further, a cleaning cloth is not easily removed from a screw part of the cleaning tool, thus allowing a user to stably clean a target surface using the tool. Since the screw part has a simple structure, the manufacturing cost of a metal mold for producing the screw parts is remarkably reduced.

Since the cleaning cloth is woven from microfiber, fine dust covering various objects, such as tables, walls, and furniture, is absorbed by the cloth without being dispersed. In addition, even if the cleaning cloth is frequently washed, the cloth maintains excellent resilience and elasticity.

Furthermore, the cleaning cloth woven from microfiber easily absorbs contaminants, so it is widely used as a damp cloth or a dry cloth.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A hand tool for cleaning a short range within reach of a user's arm, comprising a screw part to which a long cleaning cloth is helically fastened, and a handle connected to the screw part, wherein said screw part comprises:

a fitting hole receiving a fastening member for fastening the cleaning cloth to the screw part; and a plurality of annular ribs provided on the screw part at regular intervals, with a recess being formed on each of the ribs.

2. The hand tool for cleaning according to claim 1, wherein said cleaning cloth fastened to the screw part is made of microfiber, and is fastened to the screw part by attaching the cloth to the screw part, laying a packing member on the cloth at a position above the fitting hole, and fitting the fastening member into the fitting hole to fasten the packing member and cloth to the screw part.

* * * * *

UNITED STATES PATENT AND TRADEMARK OFFICE

CERTIFICATE OF CORRECTION

PATENT NO. : 6,928,688 B2
APPLICATION NO. : 10/856725
DATED : August 16, 2005
INVENTOR(S) : Daegon Nam It is certified that error appears in the above-identified patent and that said Letters Patent is hereby corrected as shown below:

In Column 1, line 7, "Jun." should be --June--

In Column 2, line 28, after "thereof" insert --.--

In Column 2, line 49 change "fly" to --firmly--

Signed and Sealed this

Eleventh Day of March, 2008

JON W. DUDAS
*Director of the United States Patent and Trademark Office*